US006065524A

United States Patent [19]

Rossini

[11] Patent Number: 6,065,524

[45] Date of Patent: May 23, 2000

[54] ACTUATOR DEVICE FOR ACTUATING A VENETIAN BLIND OR THE LIKE ARRANGED INSIDE A DOUBLE-GLAZING UNIT

[75] Inventor: Mauro Rossini, Este, Italy

[73] Assignee: Finvetro s.r.l., Este, Italy

[21] Appl. No.: 09/149,094

[22] Filed: Sep. 8, 1998

[30] Foreign Application Priority Data

Sep. 15, 1997 [IT] Italy ..... PD97A0203

[51] Int. Cl.[7] ..... E06B 9/264

[52] U.S. Cl. ..... 160/107; 160/176.1 P

[58] Field of Search ..... 160/107, 176.1 R, 160/177 R, 176.1 P; 49/82.1, 64, 86.1

[56] References Cited

U.S. PATENT DOCUMENTS

| | | | |
|---|---|---|---|
| 3,201,832 | 8/1965 | Hordis et al. | 160/107 |
| 3,722,572 | 3/1973 | Hall | 49/64 |
| 4,685,502 | 8/1987 | Spangenberg | 160/107 |
| 5,107,916 | 4/1992 | Roermund et al. | 160/6 |
| 5,396,944 | 3/1995 | Rossini | 160/107 |
| 5,699,845 | 12/1997 | Jelic . | |
| 5,769,142 | 6/1998 | Nicolosi | 160/107 |

FOREIGN PATENT DOCUMENTS

| | | |
|---|---|---|
| 0 109 382 | 5/1984 | European Pat. Off. . |
| 0 611 873 | 8/1994 | European Pat. Off. . |
| 29 21 608 | 12/1980 | Germany . |
| 95 24539 | 9/1995 | WIPO . |

*Primary Examiner*—David M. Purol
*Attorney, Agent, or Firm*—Guido Modiano; Albert Josif

[57] ABSTRACT

An actuator device connected with a blind arranged inside a hermetically sealed space of a double-glazing unit. The double-glazing unit has a pair of parallely extending glazed plates between which the hermetically sealed space is arranged, and a sealant layer extends perpendicularly between the glazed plates. The actuator device includes a first magnet which is arranged inside the hermetically sealed space, and a second magnet which is arranged externally of the hermetically sealed space. The first magnet is directly connected to a first part of the actuator device arranged inside the hermetically sealed space for actuating the blind dependent upon a sliding motion of the first magnet, and the second magnet is connected to a second part of the actuator device accessible outside of said hermetically sealed space to an operator for sliding the second magnet outside said hermetically sealed space. The first magnet is arranged to one side of the sealant layer, and the second magnet is arranged to another side of the sealant layer in a corresponding position with respect to the first magnet such that the sliding of the second magnet provided by the second part of the actuator device provides the sliding motion of the first magnet and the actuation of the blind by the first part of said actuator device.

9 Claims, 3 Drawing Sheets

ACTUATOR DEVICE FOR ACTUATING A VENETIAN BLIND OR THE LIKE ARRANGED INSIDE A DOUBLE-GLAZING UNIT

BACKGROUND OF THE INVENTION

The present invention relates to an actuator device for actuating a Venetian blind or the like arranged inside a double-glazing unit.

Venetian blinds, constituted by a set of parallel slats kept together by adjustment cords, arranged inside a double-glazing unit and are provided with magnet-based actuation means, are currently in widespread use.

The Venetian blind is usually arranged in the interspace provided between the two glazed surfaces of the double-glazing unit, which is sealed by a seal.

Both the packing and the inclination of the slats that constitute the blind are usually adjustable, by means of a magnetic coupling provided between a first magnet, which lies inside the double-glazing unit and is mechanically connected to the slat movement elements, and a second external actuation magnet.

The adjustment of blinds arranged inside double-glazing units is usually manual.

This is in particular common for home installations, in which the second magnet is moved in a straight line directly by the user along the border of the double-glazing unit whereat the first magnet is arranged internally.

The blind is usually moved by means of internal mechanical elements which convert the straight-line translatory motion of the first magnet, conveniently actuated by the second one, into a rotation and/or translatory motion of the slats of the blind.

For installations in commercial environments, such as offices, stores, industrial buildings, or in hospitals it is instead common to use a motorized actuation system to move the second magnet.

This construction, however, is more expensive and most of all can be subject to malfunctions and breakage; this is why it can be used only in particular environments.

There are also actuation devices which are arranged vertically at the frame of the double-glazing unit and other devices, mainly suitable to adjust only the inclination of the slats of the blind, which are arranged on the lateral vertical borders.

Unfortunately, the interaction between the first magnet and the second magnet always occurs in any case through one of the glazed surfaces of the double-glazing unit.

Because of this configuration, drawbacks are observed in the practical use of the blind.

SUMMARY OF THE INVENTION

The aim of the present invention is to provide an actuator device for a Venetian blind arranged inside a double-glazing unit which eliminates the above-described drawbacks of the conventional types, ensuring effective and practical operation.

A particular object of the present invention is to provide an actuator device for which the parts that are more likely to break or malfunction can be replaced easily and be subjected to maintenance without having to access the inside of the double-glazing unit.

Another object is to provide an actuator device for a Venetian blind arranged inside a double-glazing unit which can be produced with a very simple structure.

Another object of the present invention is to provide an actuator device for a Venetian blind arranged inside a double-glazing unit which can be obtained at a low cost.

In accordance with a preferred aspect of the invention, there is provided an actuator device connected with a blind arranged inside a hermetically sealed space of a double-glazing unit. The double-glazing unit has a pair of parallely extending glazed plates between which the hermetically sealed space is arranged, and a sealant layer extends perpendicularly between the glazed plates. The actuator device includes a first magnet which is arranged inside the hermetically sealed space, and a second magnet which is arranged externally of the hermetically sealed space. The first magnet is directly connected to a first part of the actuator device arranged inside the hermetically sealed space for actuating the blind dependent upon a sliding motion of the first magnet, and the second magnet is connected to a second part of the actuator device accessible outside of said hermetically sealed space to an operator for sliding the second magnet outside said hermetically sealed space. The first magnet is arranged to one side of the sealant layer, and the second magnet is arranged to another side of the sealant layer in a corresponding position with respect to the first magnet such that the sliding of the second magnet provided by the second part of the actuator device provides the sliding motion of the first magnet and the actuation of the blind by the first part of said actuator device.

BRIEF DESCRIPTION OF THE DRAWINGS

Further characteristics and advantages of the present invention will become apparent from the following detailed description of some embodiments thereof, illustrated only by way of non-limitative example in the accompanying drawings, wherein.

DESCRIPTION OF THE PREFERRED EMBODIMENTS

Figure 2:
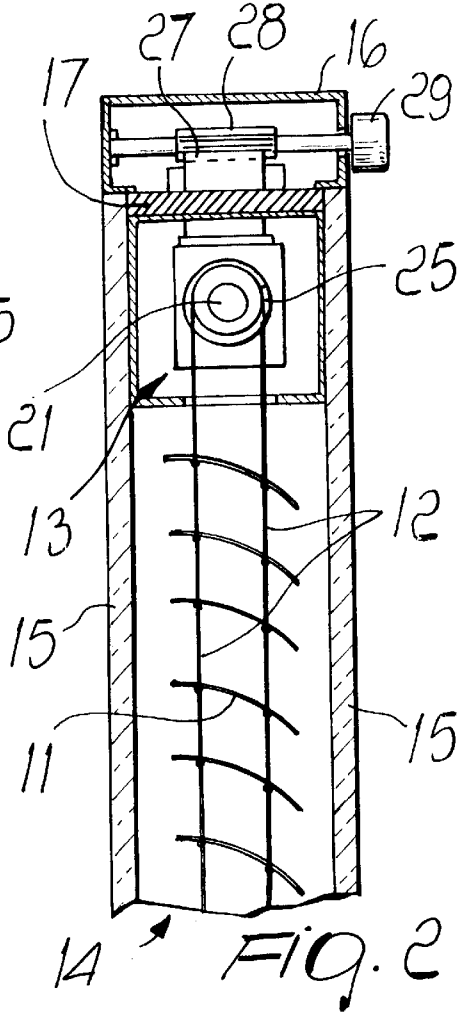
FIG. 2 is a sectional view, taken along a transverse plane, of the double-glazing unit provided with the actuator device of FIG. 1.
Figure 1:
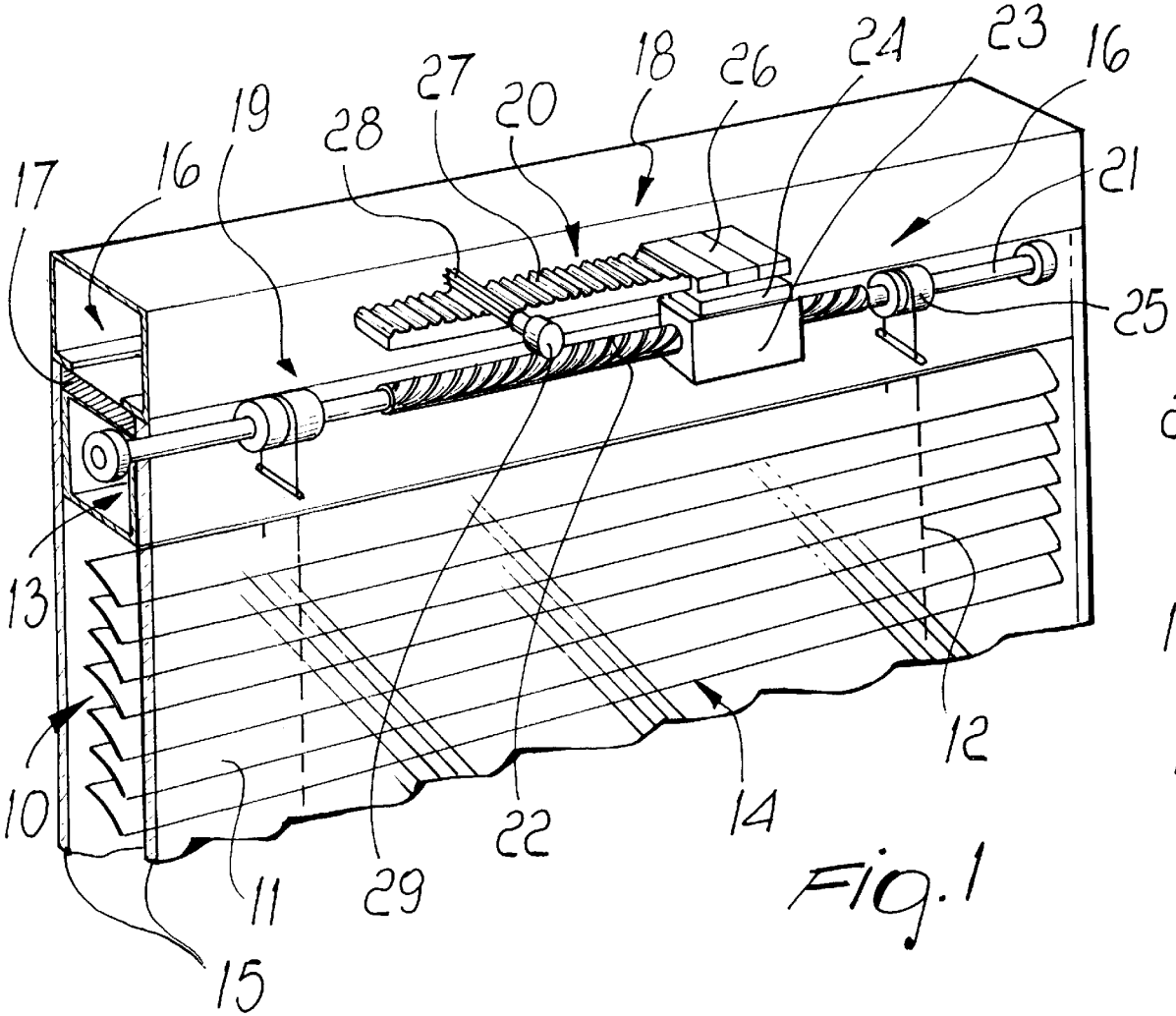
FIG. 1 is a partially sectional perspective view of the upper part of a double-glazing unit which internally accommodates a Venetian blind having an actuator device according to a first embodiment of the invention.

With reference to FIGS. 1 and 2, a Venetian blind is generally designated by the reference numeral 10 and comprises a plurality of slats which are mutually connected by cords 12 which are joined at the upper side of the perimetric frame 13 of a double-glazing unit 14 in which the Venetian blind 10 is inserted.

The double-glazing unit 14 is constituted by two glazed surfaces 15 which are mutually spaced by the contour of the perimetric frame 13, which in this case is made of aluminum.

The Venetian blind 10 has an external framework, designated by the reference numeral 16 and of a per se known type, which is arranged so as to surround the borders of the double-glazing unit 14 to support it.

A layer of sealant 17, suitable to hermetically seal the double-glazing unit 14 with respect to the outside, is spread on its edge.

The double-glazing unit 14 has an actuator device, generally designated by the reference numeral 18, comprising a first part 19 and a second part 20 of actuation means which mutually interact.

In this case, the first part 19 of the actuation means is arranged inside the frame 13 at the upper side of the double-glazing unit 14, while the second part 20 is accommodated inside the outer framework 16 which faces it.

The first part 19 of the actuation means comprises a shaft 21 which is parallel to the frame 13, is rotatably connected to the structure of the frame and has a median portion 22 which has a helical profile.

A bush 23 is connected to the median portion 22 of the shaft 21 and is internally shaped complementarily to the helical profile. A first magnet 24 is fixed in an upper region to the bush and slides at the sealant layer 17 which is interposed between the framework 16 and the frame 13.

Pulley-type supports 25 are also fixed to the shaft 21. The cords 12 wind around them and, by means of their vertical movement, produce the synchronous rotation of all the slats 11 of the Venetian blind 10 about one of their longitudinal axes.

The second part 20 of the actuation means is accommodated inside the framework 16 and comprises a second magnet 26 which is fixed at one end of a rack 27 which is parallel to the shaft 21 and whereto a pinion 28, which is rotatable about its own axis, is coupled.

The pinion 28 is rotatably connected, at its two ends, to the structure of the framework 16 and has, at one of its end portions protruding from the framework 16, a knob 29 which can be actuated manually by a user.

In practice, by suitably actuating the knob 29 the pinion 28 is turned and accordingly the rack 27 and the second magnet 26 rigidly coupled thereto are made to perform a translatory motion.

As a consequence, the first magnet 24 and the bush 23 associated therewith perform a corresponding translatory motion, thus turning the shaft 21.

This entails the rotation of the two pulley-type supports 25 and the consequent movement of the cords 12 and therefore the variation of the inclination of the slats 11 of the blind 10.

Since the kinematic system that actuates the blind 10, which is most likely to require replacement, is arranged outside the double-glazing unit 14 and is accommodated in the framework 16, in case of breakage or malfunction it can be accessed easily by simply disengaging the double-glazing unit 14 from the frame 16.

It should also be noted that the device 18 used for adjusting the inclination of the slats 11 of the blind 10 can also be used to adjust the packing of the blind or, if the blind is constituted by a single sheet, its rolling-up.

In this case it is convenient to provide the knob-shaped end 29 of the pinion 28 so that it can be actuated by a crank-type adjustment rod to facilitate the operation, which consists of a considerable number of turns.

The present invention can be subjected to numerous modifications and variations, all of which are within the scope of the same inventive concept.

Figure 4:
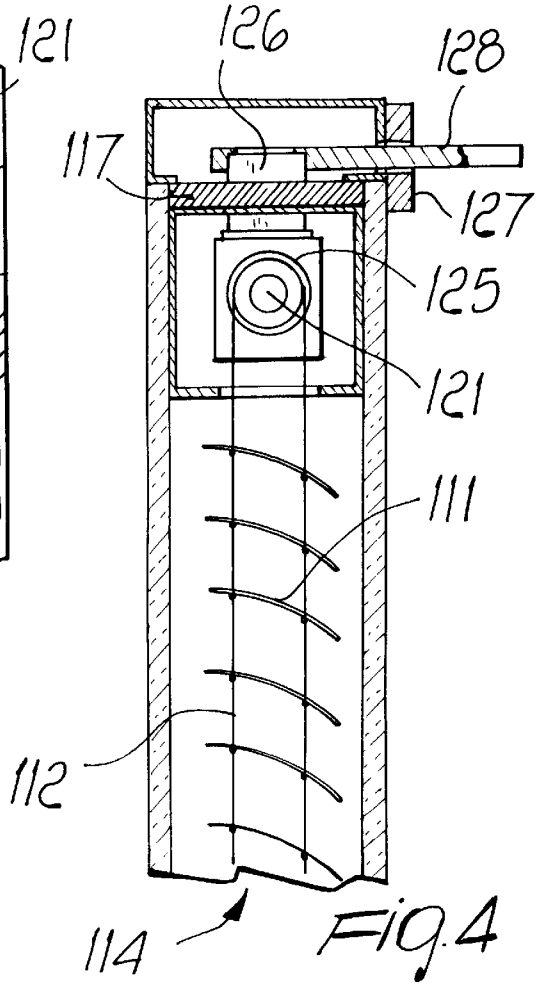
FIG. 4 is a sectional view, taken along a transverse plane, of the double-glazing unit provided with the actuator device of FIG. 3.
Figure 3:
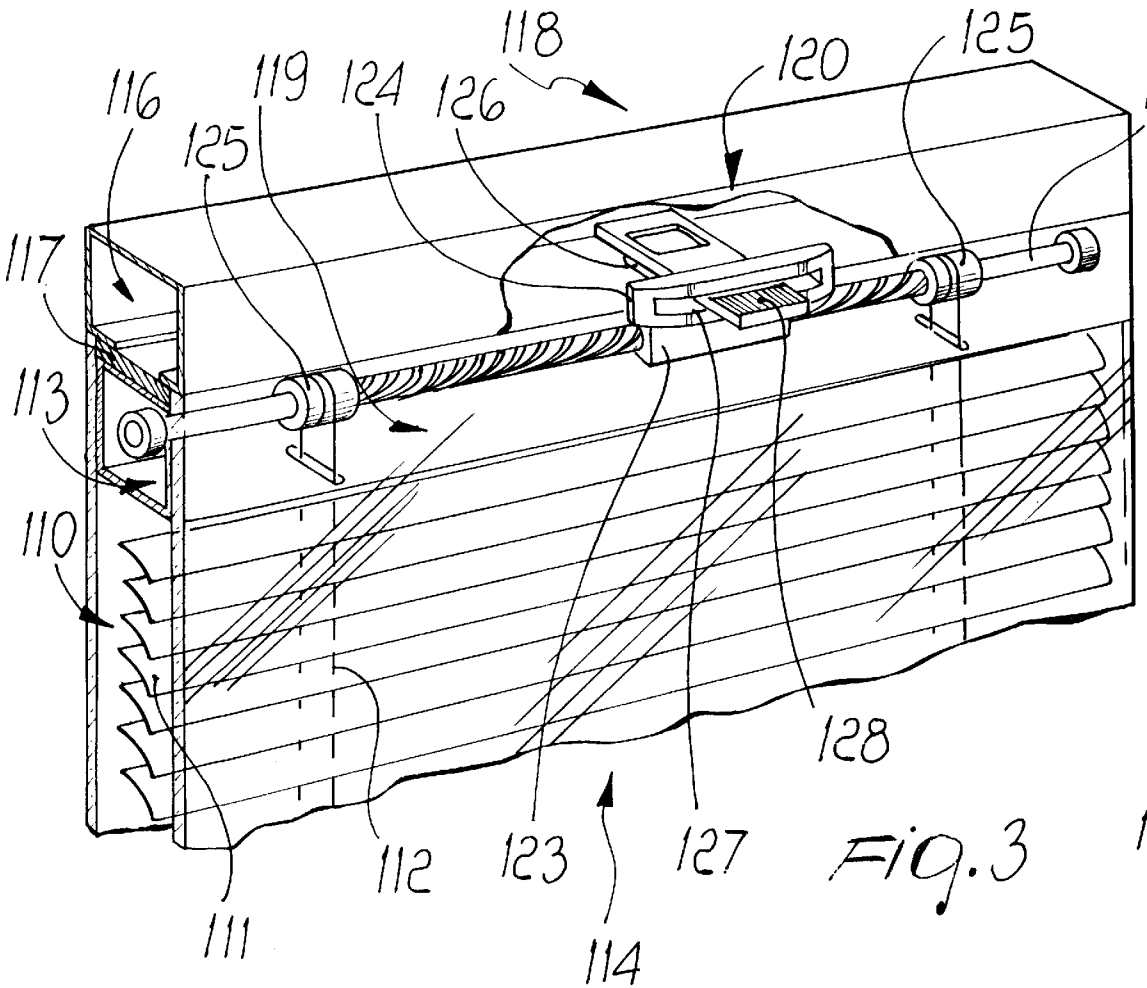
FIG. 3 is a partially sectional perspective view of the upper part of a double-glazing unit which internally accommodates a Venetian blind provided with a second embodiment of an actuator device according to the invention.

In particular, with reference to FIGS. 3 and 4, a second embodiment of an actuation device for a Venetian blind is now designated by the reference numeral 118.

The device 118 actuates a Venetian blind, now designated by the reference numeral 110, which is arranged inside a double-glazing unit, now designated by the reference numeral 114, and comprises a first part and a second part of actuation means, designated by the reference numerals 119 and 120 respectively, which mutually interact.

The first part 119 of the actuation means is fully similar to the first part 19 described earlier and is also arranged inside the perimetric frame 113 of the double-glazing unit 114 at the horizontal upper portion.

Said second part 120 of said actuation means is also arranged inside the framework, now designated by the reference numeral 116, supporting the double-glazing unit 114.

A layer 117 of sealant is arranged on the border of the frame 113 in order to hermetically close the double-glazing unit 114.

The second part 120 of the actuation means comprises, in this case, a rod-like slider 128 which can slide within a straight guide 127 formed in the structure of the framework 116 at the face that remains on the inside once the double-glazing unit 114 is installed.

A second magnet 126 is associated with the rod-like slider 128 and is coupled to the first magnet, now designated by the reference numeral 124, of the first part 119 of the actuation means.

In this manner, by operating the end of the slider 128 that can be accessed from outside, the slider is made to perform a translatory motion and slides within the guide 127; accordingly, the second magnet 126 associated with the slider 128 is also made to perform the same translatory motion.

Correspondingly, the first magnet 124 and the bush, now designated by the reference numeral 123, which is rigidly coupled thereto perform a translatory motion, turning the shaft, now designated by the reference numeral 121, and the two pulley-type supports, now designated by the reference numeral 125, consequently moving the cords 112 to vary the inclination of the slats 111 of the blind 110.

Figure 5:
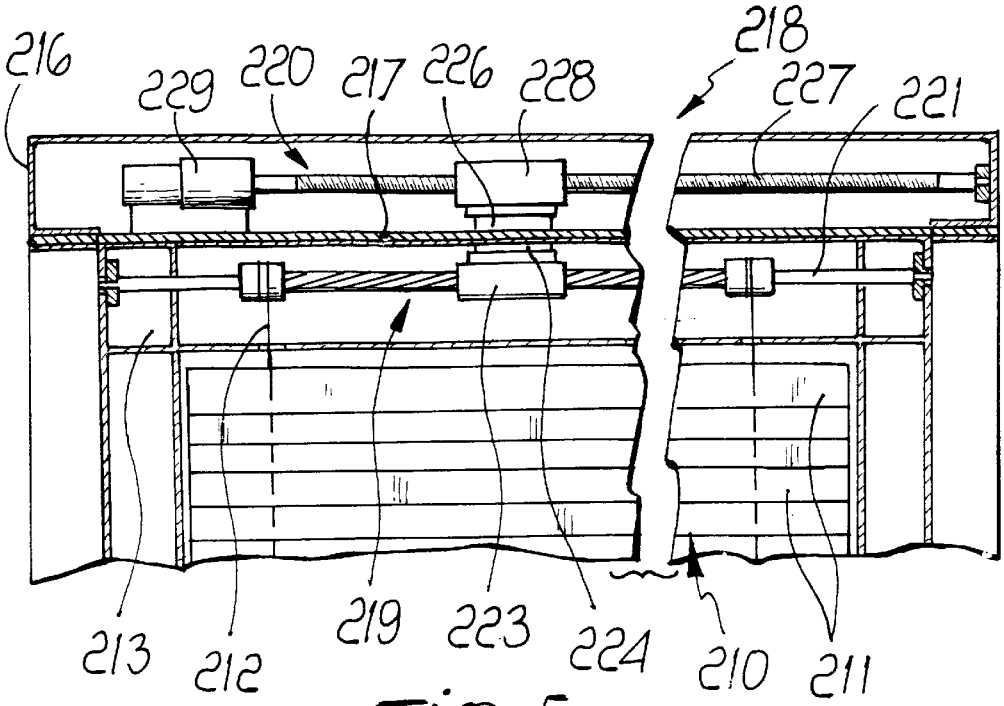
FIG. 5 is a sectional view, taken along a longitudinal plane, of the upper part of a double-glazing unit provided with a Venetian blind and with a third embodiment of an actuator device according to the invention.

With reference to FIG. 5, a third embodiment of an actuation device is designated by the reference numeral 218 and comprises a first part of actuation means, now designated by the reference numeral 219, which is fully equivalent to the preceding part 19, and a second part 220, which is arranged inside the framework, which is now designated by the reference numeral 216.

The second part 220 of the actuation means comprises a kinematic system constituted by a worm screw 227 and a nut 228; the worm screw 227 is arranged, in this case, substantially parallel to the shaft, now designated by the reference numeral 221, of the first part 219 of the actuation means, and is rigidly coupled to the output shaft of an electric gearmotor 229.

A second magnet 226 is associated with the nut 228 and is coupled, through the layer of sealant 217, to the first magnet, now designated by the reference numeral 224, of the first part 219 of the actuation means which is arranged inside the frame 213.

In this solution, therefore, by actuating the gearmotor 229 the nut 228 is moved along the worm screw 227, accordingly producing the corresponding translatory motion of the magnets 226 and 224 and of the bush, now designated by the reference numeral 223, which turns the shaft 221.

This entails the movement of the cords 212 and therefore a variation in the inclination of the slats 211 of the blind 210.

Figure 6:
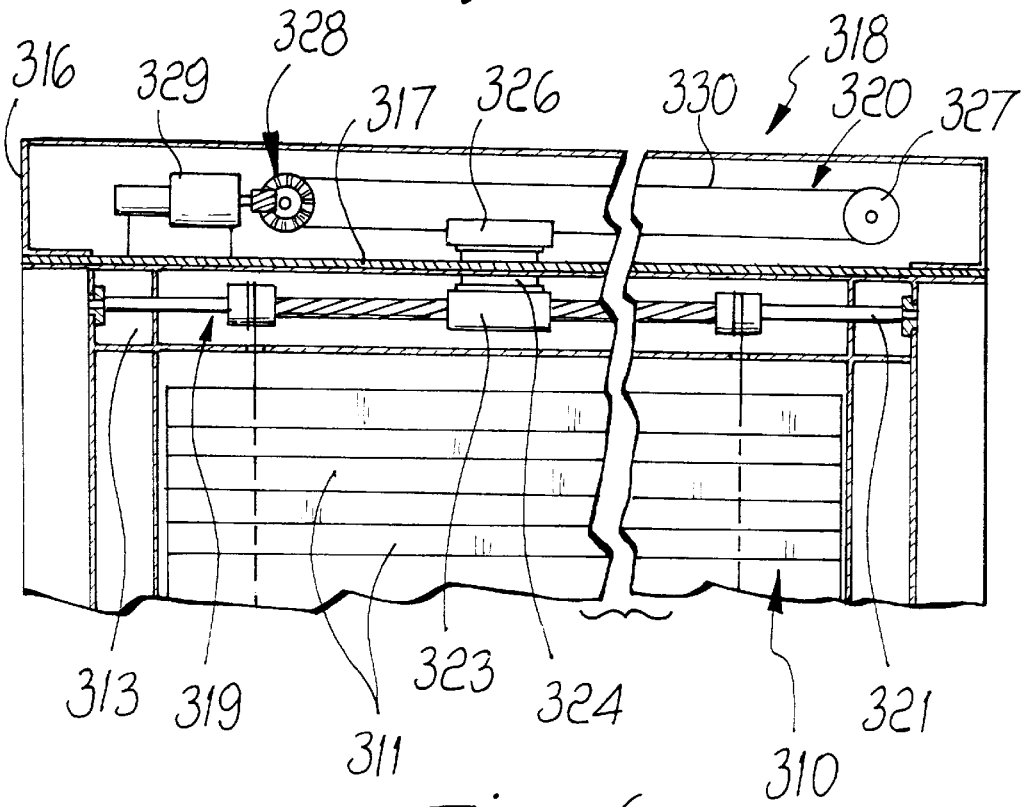
FIG. 6 is a sectional view, taken along a longitudinal plane, of the upper part of a double-glazing unit provided with a Venetian blind and with a fourth embodiment of an actuator device according to the present invention.

With particular reference to FIG. 6, a fourth embodiment of an actuation device is designated by the reference numeral 318 and comprises a first part 319 of actuation means, which is fully similar to the preceding part 19, and a second part 320, which is arranged inside the framework 316.

The second part 320 of the actuation means comprises, in this case, an electric gearmotor 329, whose output shaft is connected to a gear transmission, in this case using helical gears, which is generally designated by the reference numeral 328 and actuates a system constituted by two pulleys 327 which support a cord 330.

A second magnet 326 is fixed to the cord 330 and is coupled, through the layer of sealant, now designated by the reference numeral 317, to the first magnet, now designated by the reference numeral 324, of the first part 319 of the actuation means.

The actuation of the gearmotor 329 produces a translatory motion of the cord 330 and, accordingly, of the second magnet 326 which, coupled to the first magnet 324, correspondingly performs a translatory motion together with the bush, now designated by the reference numeral 323, which is associated therewith.

The movement of the bush 323 produces a rotation of the shaft, now designated by the reference numeral 321, and therefore the movement of the slats 311 of the blind 310.

In practice it has been observed that the intended aim and all the objects of the present invention have been achieved.

The motor drive used to operate the Venetian blind can also be arranged outside the framework that supports the double-glazing unit.

An important advantage is achieved with the present invention in that an actuator device for a Venetian blind arranged inside a double-glazing unit has been provided which can ensure effective operation with a very simple structure.

Another advantage is that it has been provided an actuator device which can be replaced easily, as regards the part likely to break or malfunction, without having to access the inside of the double-glazing unit.

All the details may be replaced with other technically equivalent elements.

In practice, the materials employed, so long as they are compatible with the contingent use, as well as the dimensions, may be any according to requirements.

The disclosures in Italian Patent Application No. PD97A000203 from which this application claims priority are incorporated herein by reference.

What is claimed is:

1. An actuator device connected with a blind arranged inside a hermetically sealed space of a double-glazing unit, said double-glazing unit comprising a pair of parallely extending glazed plates between which said hermetically sealed space is arranged, and a sealant layer extending perpendicularly between said glazed plates, said actuator device comprising a first magnet which is arranged inside said hermetically sealed space of said double-glazing unit, and a second magnet which is arranged externally of said hermetically sealed space of said double-glazing unit, said first magnet being directly connected to a first part of said actuator device arranged inside said hermetically sealed space for actuating said blind dependent upon a sliding motion of said first magnet, said second magnet being connected to a second part of said actuator device accessible outside of said hermetically sealed space to an operator for sliding said second magnet outside said hermetically sealed space, and said sealant layer for the hermetic closure of said double-glazing unit being interposed between said first magnet and said second magnet which are arranged such that said first magnet is arranged to one side of said sealant layer inside said hermetically sealed space and said second magnet is arranged to another side of said sealant layer externally of said hermetically sealed space and in a corresponding position with respect to said first magnet such that the sliding of said second magnet provided by said second part of said actuator device accessible outside of said hermetically sealed space provides the sliding motion of said first magnet and the actuation of said blind by said first part of said actuator device.

2. The device according to claim 1, wherein said first part of said actuator device comprises:

a bush with which said first magent is connected, said bush being internally provided with a helical profile;

a shaft with a profile shaped complementarily to said helical profile of said bush in which said shaft is rotatably supported;

pulley supports being fixed to said shaft; and winding cords wound about said pulley supports and connected to said blind for the actuation of said blind.

3. The device according to claim 2, wherein said second part of said actuator device comprises:

a rack which is slidingly coupled to a framework attached to said double-glazing unit adjacent said sealant layer externally of said hermetically sealed space; and a pinion coupled to said rack and having a protruding end protruding from said framework and accessible to an operator for sliding said second magnet;

said rack having one end with which said second magnet is connected.

4. The device according to claim 2, wherein said second part of said actuator device comprises a slider which is sliceable in a guide which is formed in a framework attached to said double-glazing unit adjacent said sealant layer externally of said hermetically sealed space, said slider having a first end with which said second magnet is connected, and a second end protruding from said framework and accessible to an operator for sliding said second magnet.

5. The device according to claim 2, wherein said second part of said actuator device comprises a kinematic system constituted by a worm screw and a nut in which said worm screw is rotatably supported, said worm screw being rigidly coupled to an output shaft of a motor drive and said nut being connected with said second magnet.

6. The device according to claim 2, wherein said second part of said actuator device comprises a gear transmission for moving pulley supports for a cord, said second magnet being fixed to said cord, and said transmission being rigidly coupled to an output shaft of a motor drive.

7. The device according to claim 2, wherein a step-up gear system is interconnected between said shaft and said pulley supports of said first part of said actuator device.

8. The device according to claim 5, wherein said worm screw and nut are arranged inside a framework attached to said double-glazing unit adjacent said sealant layer externally of said hermetically sealed space, and wherein said motor drive is arranged outside said framework.

9. The device according to claim 6, wherein said gear transmission and said pulley supports and said cord are arranged inside a framework attached to said double-glazing unit adjacent said sealant layer externally of said hermetically sealed space, and wherein said motor drive is arranged outside said framework.

* * * * *